US005611770A

United States Patent [19]

Tesch

[11] Patent Number: 5,611,770

[45] Date of Patent: Mar. 18, 1997

[54] LEG STRETCHING APPARATUS

[76] Inventor: Charles V. Tesch, 4704 John Cones Pl., Jonesboro, Ark. 72401

[21] Appl. No.: 534,448

[22] Filed: Sep. 27, 1995

[51] Int. Cl.[6] ..... A61H 1/02

[52] U.S. Cl. ..... 601/34; 601/27; 482/80; 482/131

[58] Field of Search ..... 482/91, 125, 79, 482/80, 131, 139, 907, 148; 601/5, 27, 29, 31, 32, 33, 34, 89, 90, 97, 98; 602/29

[56] References Cited

U.S. PATENT DOCUMENTS

| | | | |
|---|---|---|---|
| 828,221 | 8/1906 | Langel | 482/79 |
| 1,546,506 | 7/1925 | Naysmith | 482/79 |
| 2,664,886 | 1/1954 | Coffman | 601/27 |
| 4,432,543 | 2/1984 | Normandin | 601/27 |
| 4,474,176 | 10/1984 | Farris et al. | 601/27 |
| 4,669,450 | 6/1987 | Lindberg | 601/33 |
| 4,844,454 | 7/1989 | Rogers | 482/131 |
| 5,046,487 | 9/1991 | Scott | 601/27 |

FOREIGN PATENT DOCUMENTS

| | | | |
|---|---|---|---|
| 1644986 | 4/1991 | U.S.S.R. | 482/79 |
| 8802249 | 4/1988 | WIPO | 601/31 |

*Primary Examiner*—Richard J. Apley
*Assistant Examiner*—Jeanne M. Clark
*Attorney, Agent, or Firm*—J. David Haynes

[57] ABSTRACT

A leg stretching apparatus comprises an L-shaped, leg and foot support assembly for receiving the leg in straight and bent positions, and the foot in varying positions, including positions of inversion and eversion, to stretch the muscles of the lower leg. The extended portion of the foot support member is pivotally connected to the leg support member, and is adjustably connected by second-class levers to the leg support member to enable a debilitated person to easily exert sufficient force to stretch the various muscles of the lower leg by causing the foot support member to rotate the foot of a patient about the axis of the patient's ankle and to quickly release the exerted force which is exerted by the second-class lever.

6 Claims, 6 Drawing Sheets

LEG STRETCHING APPARATUS

BACKGROUND—FIELD OF INVENTION

1. Field of the Invention

The present invention relates to an apparatus used in the field of kinesiotherapy for applying varying tension force to stretch the calf muscles of the leg and, more particularly, the gastrocnemius muscle (which can only be stretched properly when the leg is straight) and the soleus muscle (which can only be stretched when the leg is bent) to increase the range of motion of the ankle, primarily for the physically debilitated.

2. Description of the Related Art

Various problems and difficulties are being encountered in providing suitable means for the disabled and the physically debilitated with respect to stretching the calf muscles to enable the patient to be ambulatory as opposed to exercising the muscles or strengthening the muscles. The musculature of the lower leg, ankle, and foot is frequently found in a weakened or atrophied condition in addition to the loss in range of motion normally resulting from immobilization. There is an existing need for an apparatus whereby the unhealthy limbs corroborate with the apparatus to easily stretch the unhealthy limbs. Also needed is an apparatus that is dynamic and thus allows the effort supplied to stretch to be quickly relieved in order for needed blood to be quickly returned to tissues before unnecessary pain becomes too severe.

One of the most common ways to stretch these muscle groups is by sitting on the floor in a "pike" position, with legs straight in front, reaching toward the toes and pulling the toes toward the chest by various means, in a "pike" position. This method is very difficult, particularly for the physically debilitated who are unable to exert the effort required to stretch the muscles. In the past, various types of leg stretching apparatuses have been used. However, these devices are not equipped for use by the physically debilitated who either do not have the physical strength to apply the appropriate effort or who are unable to stand or sit in a position necessary to use these devices.

U.S. Pat. No. 5,004,228 to Scott Powers discloses the leg stretching apparatus wherein a foot supporting means is positioned across the bottom of the feet and has handgrips on a placement strap which are grasped by the user to apply force to the bottom of the foot.

U.S. Pat. No. 4,669,450 to Warren N. Landberg discloses an apparatus where the leg and foot is placed into an L-shaped apparatus which has a cord attached at the extremity above the toes of the foot for applying pressure to the foot to cause the foot to move upward to stretch the calf in a variety of static positions.

U.S. Pat. No. 5,122,106 discloses a stretching apparatus wherein the leg is placed into an L-shaped cradle, and the entire leg is rotated upwardly while the user is in a supine position to stretch only the hamstring muscle of the leg.

U.S. Pat. No. 4,270,749 to William D. Hebern discloses a device which one uses to exercise leg muscles while standing in an upright position.

U.S. Pat. No. 4,951,938 to Christopher J. B. Smith, IV discloses an exercising shoe which has a semi-circular base which exercises the leg as one rotates the shoe upon its semi-circular base.

U.S. Pat. No. 4,429,868 to James S. LeBlanc discloses a device for use in stretching the calf muscles of the leg which comprises a platform upon which the user places the foot in an elevated manner, while standing, to stretch the calf muscles.

U.S. Pat. No. 4,186,920 to Russell D. Fiore discloses an apparatus which has a foot support member positioned on the top thereof which is operable to provide selective resistance to tilting of the foot and not stretching the calf muscles while it is positioned in said apparatus.

U.S. Pat. No. 3,984,100 to Lawrence D. Firster discloses a platform having a bubbler member on the bottom where the user stands on the platform and rotates the platform on the bubbler member to exercise the leg.

There are prior art devices for exercising or stretching the leg and the calf muscles; they generally relate to exercise apparatuses that are used by individuals who are physically capable and have the strength to implement the exercise procedure and not apparatuses for stretching the calf muscles of persons who lack physical strength. Many are cumbersome and expensive and not adaptable for the physically debilitated who are either bedridden or in wheelchairs or unable to stand or walk or supply the physical effort to use the devices at the time of administering the therapy.

There is a difference between "stretching," "strengthening," and "stamina," Stretching permits a debilitated leg to become wholly or partially functional again. Strengthening permits a muscle to become stronger even though there is nothing wrong with the muscle such a body building exercises. Stamina has to do with endurance like the ability to run a long distance. There is a need in the prior art for an apparatus for use for physically infirm persons who need to stretch the leg muscles so that they may walk or walk better than before the muscles were stretched. Exercise without stretching will not result in increased ambulatory functions.

SUMMARY OF THE INVENTION

The above-discussed and other limitations and prior art apparatuses ostensibly designed to stretch the body muscles are addressed in the present invention which provides an apparatus for stretching the calf muscles and joint capsules of the foot in a controlled and an easily implementable manner. It is an invention providing apparatus and method whereby the user can apply sufficient force to stretch the calf muscles while either lying in bed or sitting through the means provided through the second-class lever actions which constitute a part of the invention and whereby the force may be quickly released to permit the blood to return to the stretched tissues. The foot may be inverted or everted when the muscles are being stretched.

A further object of the invention is to provide an apparatus usable by the patient with little or no supervision or assistance. The preferred embodiment of the present invention and foregoing objects are accomplished for providing a rigid leg board which receives the leg in a straight or bent position which has a rigid foot board which receives the foot in a flat or turned position and is pivotally connected to the leg board with respect thereto and having a second-class lever connected between the foot board and the leg board which permits the user to grasp the lever to either exert sufficient force to manipulate the foot board so as to apply stretching force to the calf muscles of the lower leg and to the heel cord or readily relieve the force when necessary and provide such a device which is relatively inexpensive and adapted for use in a confined area.

Yet another object of the invention is to cause the foot to be rotated about the axis of the ankle and not the heel of the foot.

These, and other objects and advantages will become apparent as the description proceeds.

BRIEF DESCRIPTION OF THE DRAWINGS

These, as well as further objects and advantages of the invention, will become apparent to those skilled in the art from a review of the following detailed specification of my invention, reference being made to the accompanying drawings in which.

DETAILED DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize its teachings.

Referring now more particularly to the drawings, wherein like numerals represent like elements throughout specifications.

Figure 10:
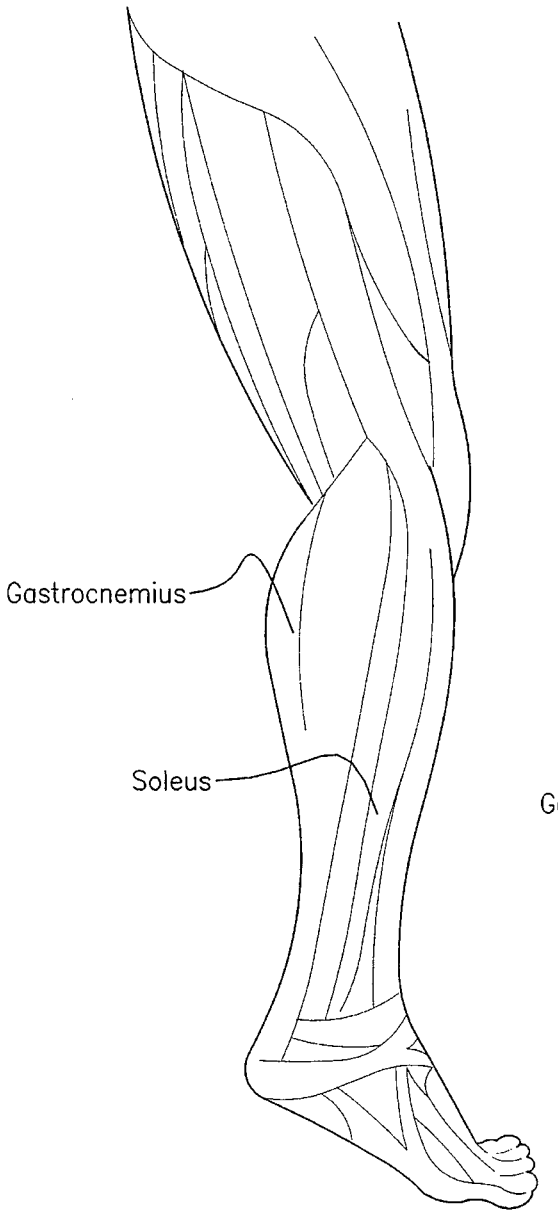
FIG. 10 is a diagrammatic view of a human leg showing some of the muscles of the leg which may be stretched through the use of this apparatus.
Figure 11:
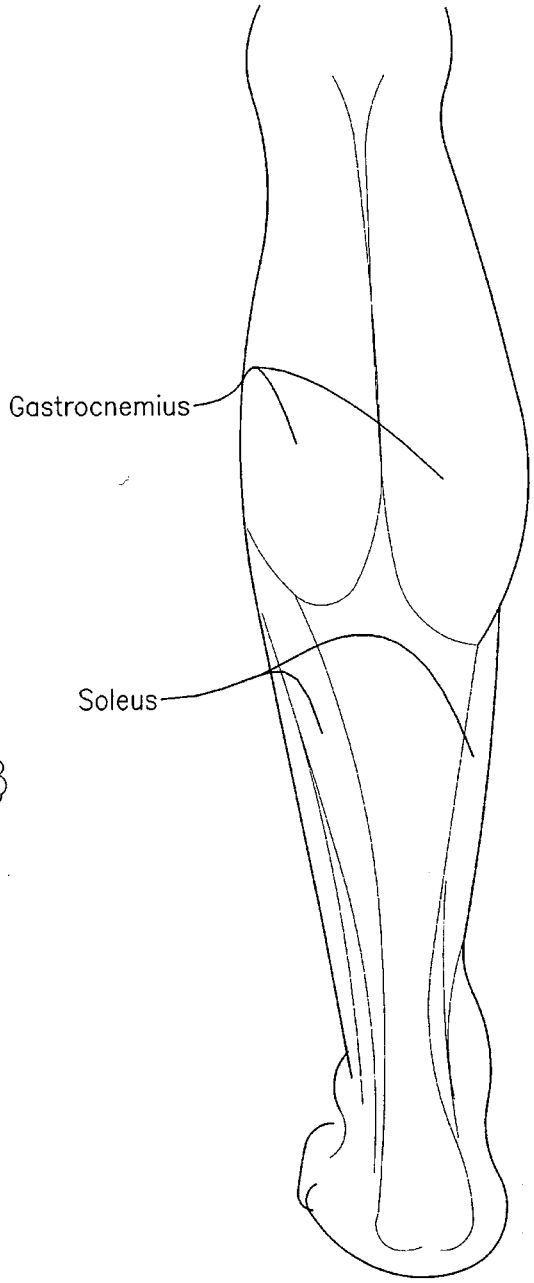
FIG. 11 is a diagrammatic view of a human leg showing some of the muscles of the leg which may be stretched through the use of this apparatus.

FIGS. 10 and 11 disclose a general muscular diagram of a human leg. The main muscles for which the present invention is to provide a stretching motion are the gastrocnemius and soleus muscles as shown in this particular diagrams. The muscles shown in FIGS. 10 and 11 are commonly referred to as calf muscles or the muscles of the lower leg. These figures are for the purpose of representing the muscular configuration of a human leg.

Figure 1:
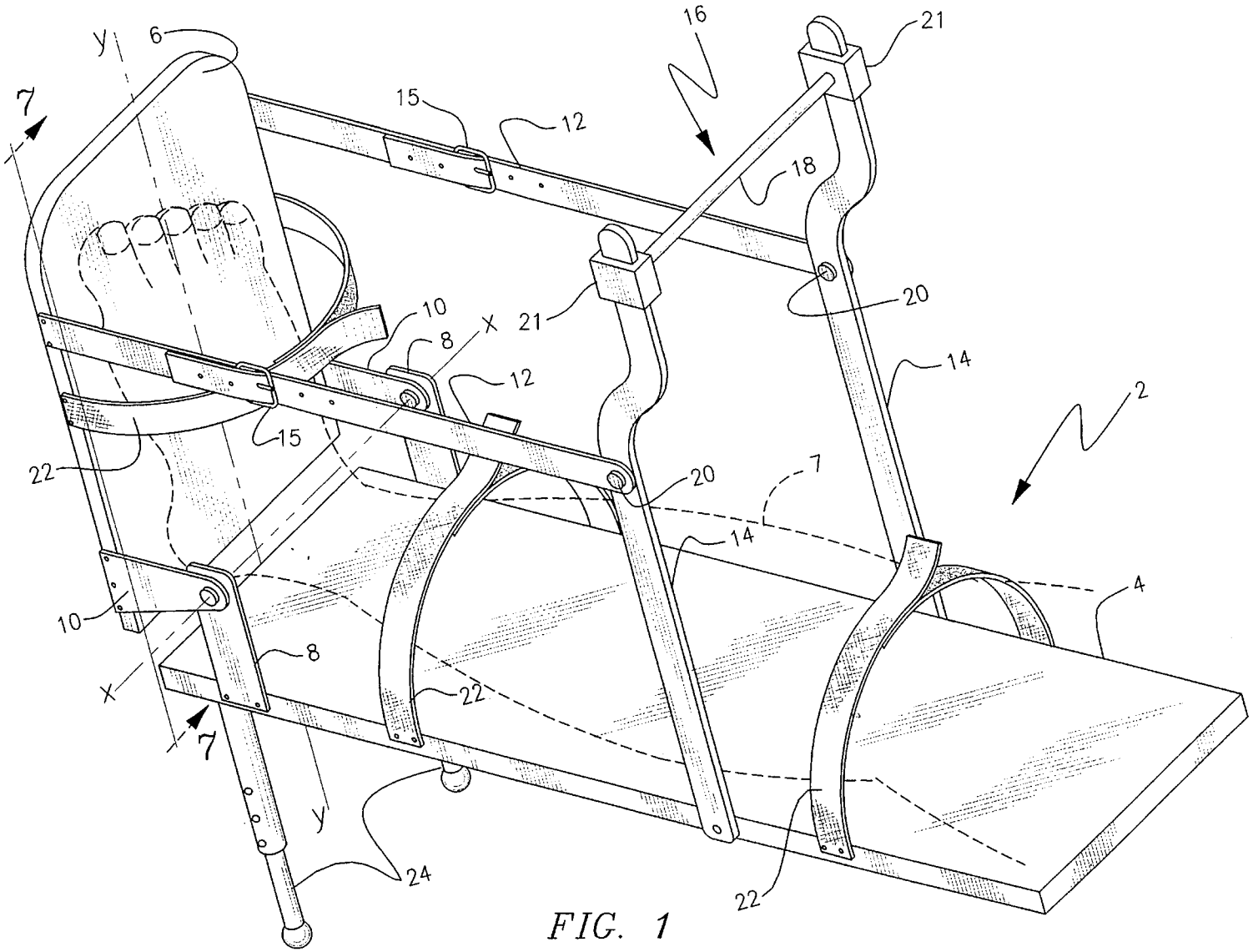
FIG. 1 is a somewhat diagrammatical top perspective of a leg stretching apparatus in accordance with the present invention.

Referring now to FIG. 1 of the drawings, a leg stretching apparatus 2 is disclosed which is basically L-shaped and comprises a leg board member 4 for supporting the leg of a patient and a foot support member 6 for receiving the foot of the user. A leg 7 is shown in dashed lines as the user would position the leg in the apparatus for use.

Foot board 6 is rotatably connected to leg board 4 by support members 8 and 10. Vertical support member 8 is fixedly attached to the leg board 4 near its first end and rotatably connected to a horizontal support 10 which is fixedly connected to foot board 6 near its heel portion. The axis x formed where vertical support 8 and horizontal support 10 rotatably connect is positioned above leg board 4 such that the axis of rotation 6 of the ankle of the patient using such apparatus is in substantial alignment with axis x as foot board 6 rotates relative to the leg board 4.

A second-class lever is operationally positioned between foot board 6 and leg board 4. The lever comprises an adjustable longitudinal member 12 and a vertical member 14. Longitudinal member 12 is rotatably connected near the toe of the foot board 6 and to the vertical member 14 at a point between the first end of the vertical member 14 which is connected to the leg board 4 and its second end whereby a force applied at or near hand grip 16 results in a greater force being applied to the toe portion of the foot board 6 than would be applied by merely pulling on the foot board. The present lever action causes the foot board to rotate about axis x. A second-class lever is provided on the left side as well as the right side of foot board 6. A hand grip 16 may be provided between the lever on the left side and the lever of the right side of leg board 4. The grip handle 16 may comprise a circular rigid member 18 connected to hollow rectilinear members 21 at each end wherein the rectilinear members 21 are so dimensioned that they will fit over the top of members 14 for easy removal.

As used herein, the term "second-class lever" is used to define a device consisting of a bar turning about a fixed point, the fulcrum, positioned near a first end of the bar, using power or force applied at a second point, the opposite end of the bar where the patient would grasp the lever, using power force applied at a second point to lift or sustain a weight at a point between the first and second ends of the bar as more particularly defined in *Webster's New World Dictionary of American English, Third College Edition* (1988), Pages 776 and 777.

Whereas it is not a necessary a element of this invention, members 14 may have a dog-leg configuration such that the portion which the patient would grasp will be nearer the patient than the pivot point 20 where vertical members 14 adjoin horizontal members 12. In the preferred embodiment, the rotational connection or pivot points 20 between horizontal member 12 and vertical member 14 may be positioned at the dog-leg junction of the vertical member 14.

Longitudinal members 12 are adjustable to accommodate patients having different lengths of legs so that the foot of the user may be vertical when the vertical members 14 are also in their most vertical position. A buckle 15 or other known means may be used to adjust member 12.

Adjustable straps 22 are located on the foot board and the leg board to fixedly secure the leg of the user into position prior to use. It is important that the leg be held firmly in position in order to provide maximum stretching to the muscles of the lower leg. The adjustable straps 22 must be placed such that the pressure will not adversely affect the nerves or impede blood supply.

It should be noted that the foot board is aligned to rotate in substantial alignment with the axis of the ankle. This permits the foot of the user to rotate in a natural way by permitting the toes of the foot to move forward toward the patient while the natural movement of the heel is away from the patient to provide a motion not available in the prior art. The levers permit debilitative person having minimal strength to cause a greater force to be applied to the foot to stretch the muscles of the lower leg than would result by merely pulling at the top of the foot board through a member which does not comprise part of a levered motion.

The apparatus may be equipped with adjustable, removable legs 24 which are available in the prior art. The legs may be screwed into receptacles 28 on the bottom of the apparatus or connected by other means. This is more particularly shown in FIG. 8; the legs may be adjusted in length by means generally known in the prior art (FIG. 1). The purpose of having legs which are removable is to permit the apparatus to be used by someone who may be bedridden as well as someone who may be in a wheelchair and wish to have the apparatus supported between the wheelchair at its second end and supported on the floor at its first end where the foot board is rotatably attached to the leg board.

Figure 3:
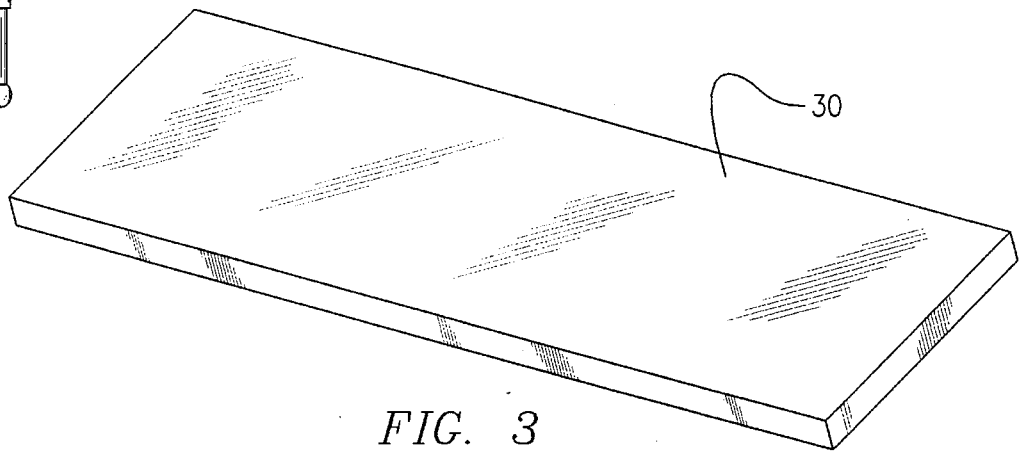
FIG. 3 is a perspective view of a straight knee pad.
Figure 4:
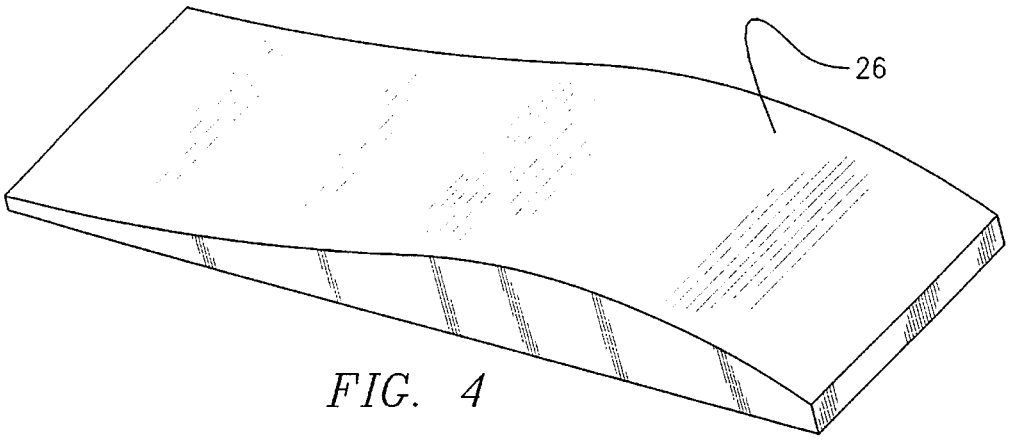
FIG. 4 is a perspective view of a bent knee pad.

Referring to FIGS. 3 and 4, a flat leg pad 30 is made out of soft material and dimensioned so as to be placeable on top of the leg board 4 such that the patient's leg is laying on the flat leg pad during use. This permits certain muscles of the lower leg to be stretched such as the gastrocnemius which can only be stretched when the leg is straight. Alternatively, the bent knee pad 26 may be placed on the top of the leg board 4 to thus cause the leg of the user to be bent at the knee when applying the force to the foot board. This permits certain muscles to be stretched such as the soleus which can only be stretched when the knee is bent.

Figure 5:
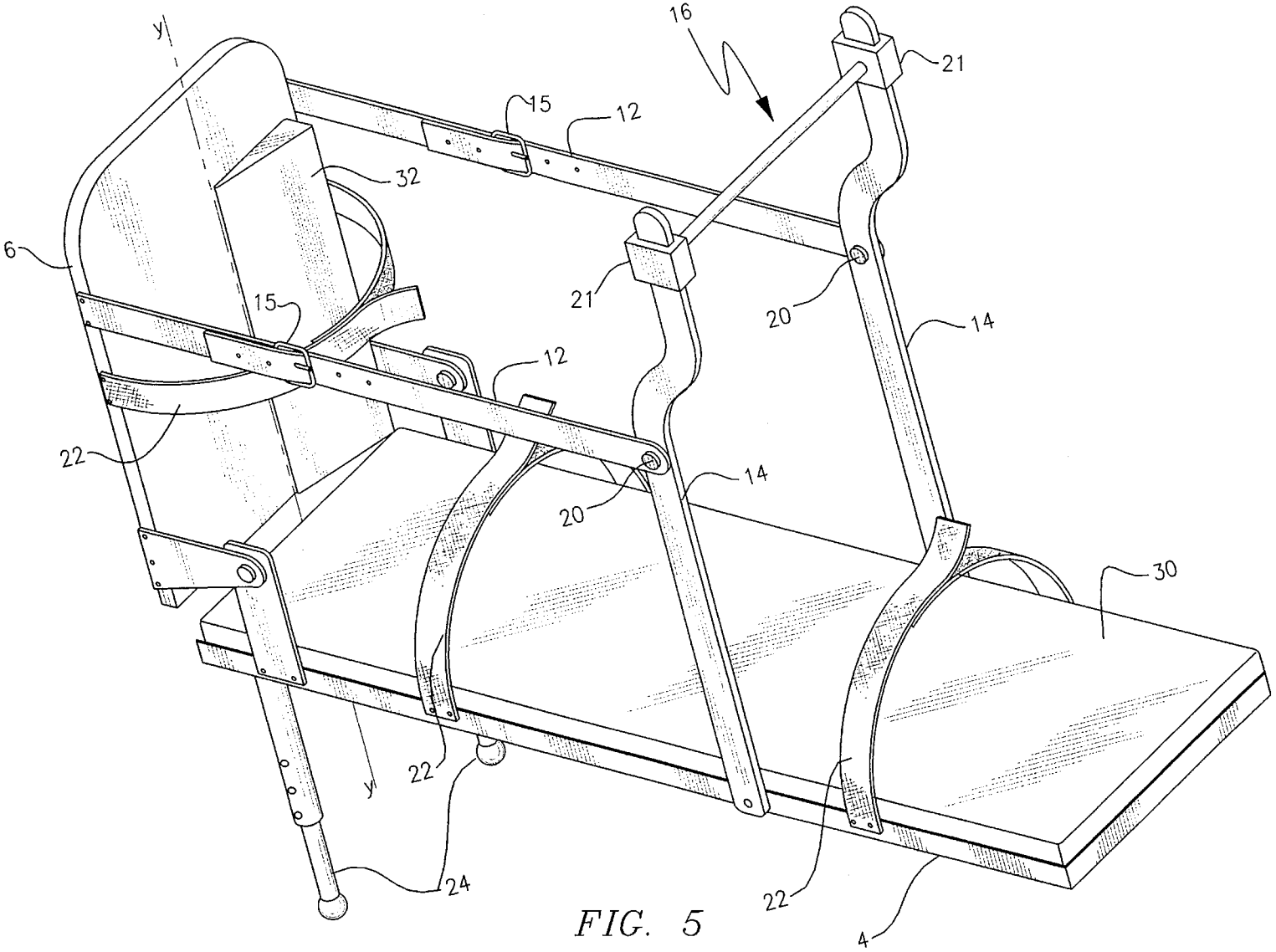
FIG. 5 is a somewhat diagrammatical perspective of the apparatus of FIG. 1 with the straight knee pad of FIG. 3 in place and an inversion/eversion foot pad.
Figure 9:
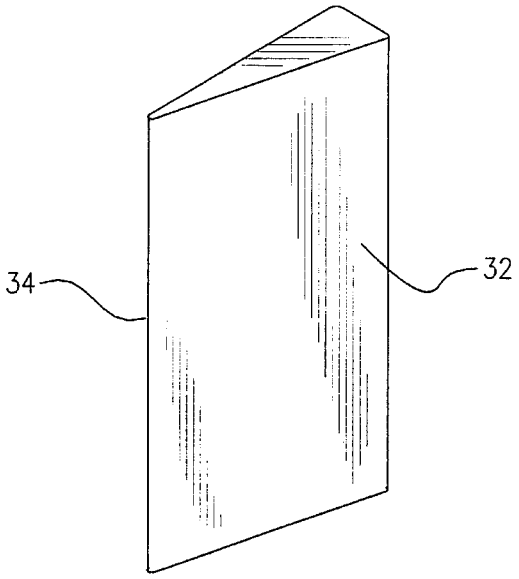
FIG. 9 is a perspective view of the inversion/eversion pad for use with the present apparatus.

FIG. 9 discloses a wedge-shaped pad 32 which may be placed on footboard 6 as shown in FIG. 5 so that the wedge-shaped pad 32 is either partially or wholly under the foot of the user during use of the apparatus. The apex 34 may be aligned along axis y—y (FIG. 5) with the large toe of the foot and the heel of the foot (eversion) or aligned along the outside or lateral part of the foot to cause the foot to tilt inwardly (inversion). The wedge-shaped pad may be placed under the foot to cause the foot to be tilted inwardly or outwardly. Wedge-shaped pad 32 may be placed wholly underneath the foot as one may so elect to cause the foot to assume different positions. As one may appreciate, the angle of the foot during use will cause different muscles to be stretched while the leg is straight.

Figure 6:
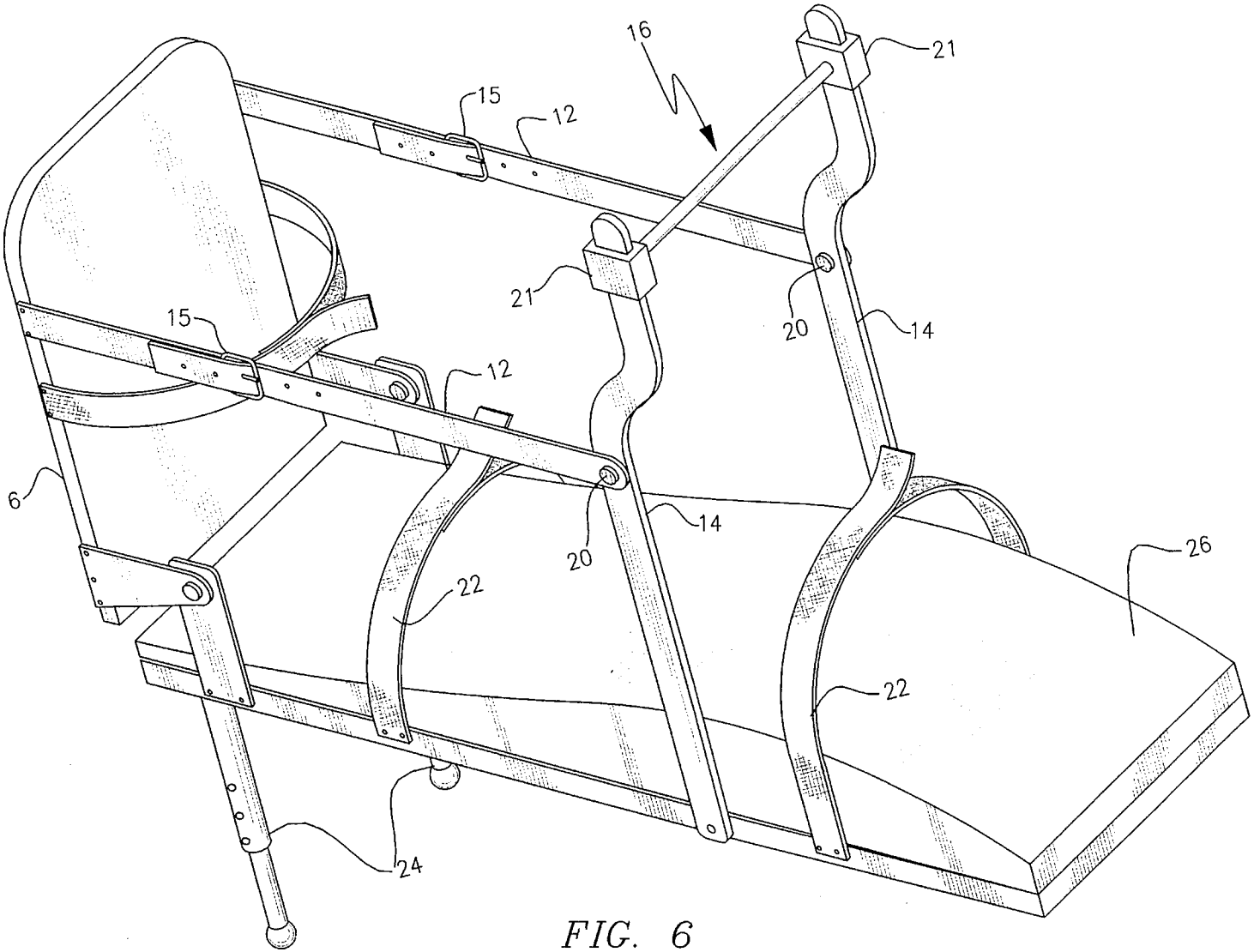
FIG. 6 is a somewhat diagrammatical perspective of the apparatus of FIG. 1 with the bent knee pad of FIG. 4 in place.
Figure 7:
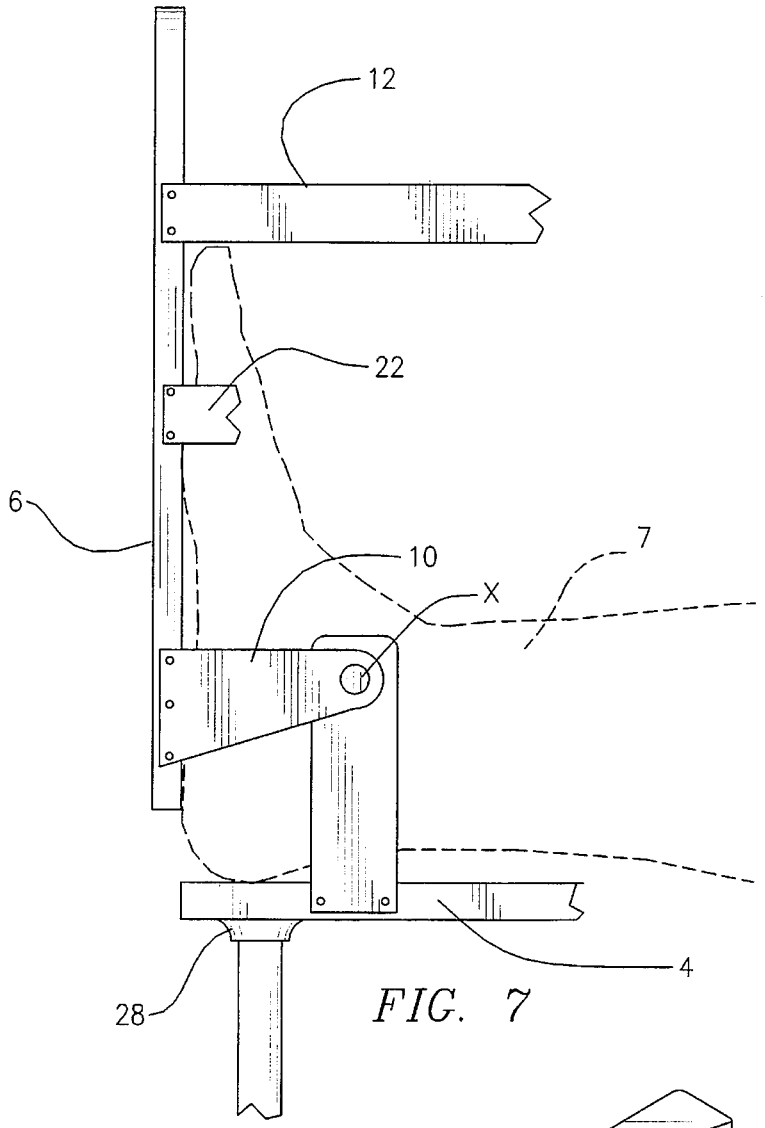
FIG. 7 is a somewhat diagrammatical fragmentary side elevation of FIG. 1 along line 7—7.

Referring now to FIG. 7, a side view of the foot board is shown with the patient's foot in situ. The foot is secured to the foot board 6 by adjustable strap 22. As the foot board rotates about axis x (FIG. 1), it can be appreciated that the axis of the ankle and the axis x of rotation of the foot board 6 with respect to the leg board 4 are in substantial alignment to cause the foot to benefit from a rotation about a natural rotational axis for the angle to thus stretch the muscles of the lower leg. In this particular embodiment, the flat knee pad 30 may be used as shown in FIG. 5 while it should be appreciated that the bent knee pad 26 may be used as shown in FIG. 6 under the leg and heel of the user to cause the stretching of different muscles which may only be stretched while the leg is bent such as the soleus muscle.

Figure 2:
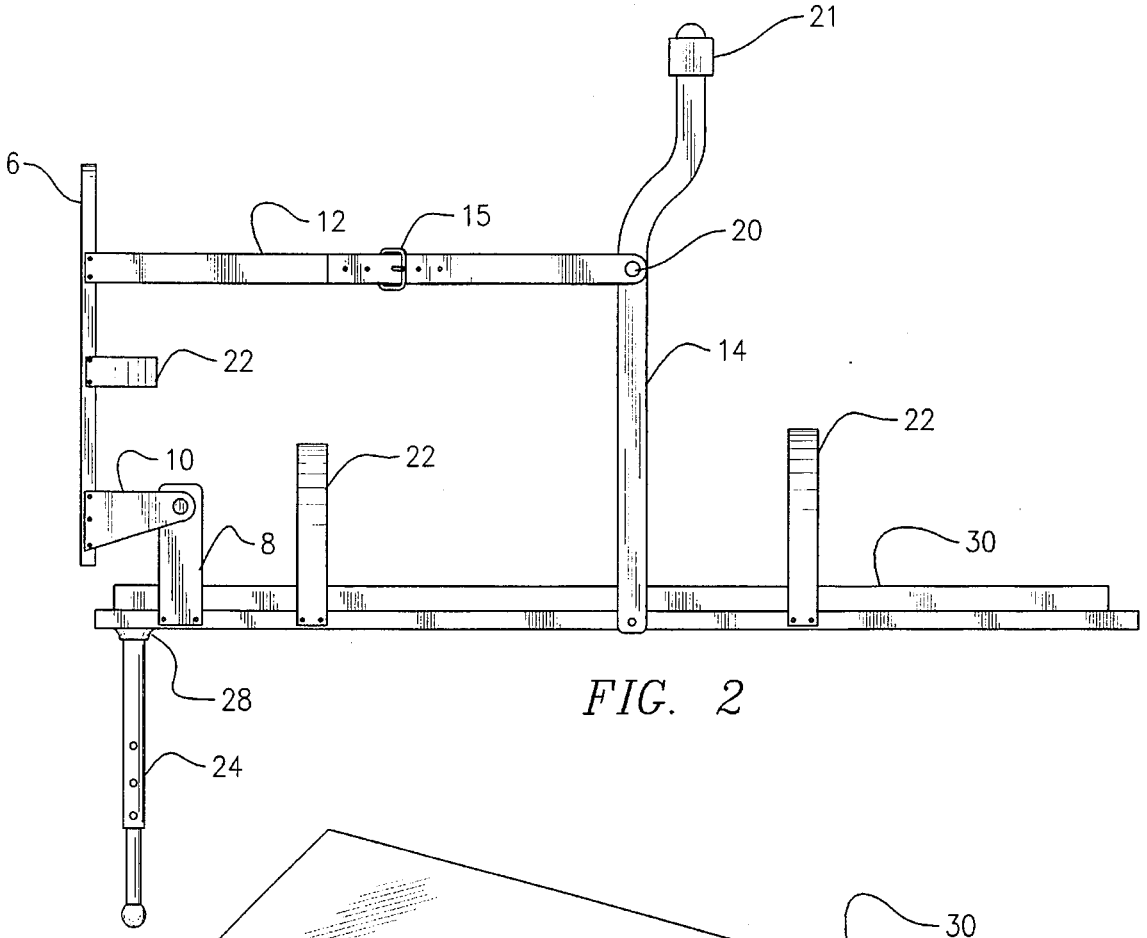
FIG. 2 is a somewhat diagrammatical left side view of the perspective disclosed in FIG. 1.

Referring to FIG. 2, like numerals are used here to indicate the same components of the apparatus as are disclosed and discussed regarding FIG. 1.

Referring to FIG. 5, the apparatus is shown with a flat knee pad 30 in place as it would be used when the leg is to be straight to stretch muscles such as the gastrocnemius muscle. The inversion/eversion pad 32 is positioned upon foot board 6 as the user may desire. Generally, it is desirable that the pad be aligned so that the apex 34 is either aligned with the large toe or aligned with the lateral part of the foot. One position causes the foot to be inverted, while the other causes the foot to be everted. It could be said that if one were walking along the apex of a roof that the person's feet would be inverted while one walking along the valley of a roof with his feet on the slanted portion of the roof, that his feet would be everted. The inversion/eversion pad 32 permits stretching of only one of the two heads of the gastrocnemius muscle at a time. The eversion pad stretches the medial or inside muscles of the lower leg and the inversion pad stretches the lateral or outside muscle of the lower leg.

Referring to FIG. 6, the apparatus is shown with a bent knee pad 26 in place which permits the leg of the user to be bent while the calf muscles are being stretched. This permits the soleus muscle to be stretched which may only be stretched when the knee is bent.

Figure 8:
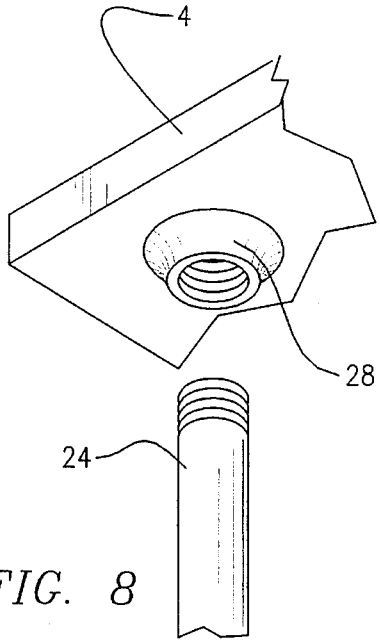
FIG. 8 is a partial perspective of a leg 24 as it adjoins by board 4, with the leg unscrewed.

Referring now to FIG. 8, a traditional state of the art attachment means is shown which permits the support legs 24 to be screwed to leg board 4.

FIGS. 10 and 11 disclose the leg muscles tendon complexes. The movement of the foot in conformity with the foot board 6 naturally induces movement that softly stretches the lower leg. Each muscle complex can be isolated and allowed to stretch dynamically without complication from other connective groups. The applied pressure may be quickly released by releasing the handles of the lever.

What I claim as my invention is:

1. A therapeutic apparatus for stretching the muscles of the lower leg of a patient comprising:

a leg board having a first end, a second end, a top side, a left side, and a right side for fixedly receiving the leg of a patient on said top side thereof;

a foot board having a heel portion and a toe portion, a top side for receiving the foot of a patient, and a left side, and a right side;

means for applying a force near the toe portion of the foot board to cause the top of the patient's foot to be forced toward the patient to thus stretch the muscles of the calf of the patient's leg;

means for rotatably supporting said foot board above said leg board wherein said means comprises:

a first vertical support member positioned on the left side leg board near its first end;

a second vertical support member positioned on the fight side of said leg board near its first end;

a first horizontal support member positioned near said heel portion of said foot board and rotatably connected to said first vertical support member a second horizontal support member positioned near said heel portion of said foot board and rotatably connected to said second vertical support member, whereby the said force when applied near the toe portion of the foot board causes the foot of the patient to generally rotate about the ankle of the patient with the toes of the patient being forced toward the patient while the heel portion of said foot board and thus the heel of the patient moves away from the patient; and wherein the said means for applying a force near the toe portion of a foot board comprises:

a first second-class lever operatively positioned between said left side of said foot board near said toe of said foot board and said left side of said leg board near said second end of said leg board and a second second-class lever operatively positioned between said right side of said foot board near said toe of said foot board and said right side of said leg board near said second end of said leg board, wherein said first second-class lever and said second second-class lever comprise:

a first rigid elongated member having a first end rotatably connected to the left side of said leg board near the said second end of said leg board and a second end adapted to be grasped by the user and extending upwardly from said top side of said leg board, a second rigid elongated member having a first end rotatably connected to the right side of said leg board near the said second end of said leg board and a second end adapted to be grasped by the user and extended upwardly from said top side of said leg board, a first longitudinally adjustable member having a first end rotatably connected to said left side of said toe portion of said foot board and a second end rotatably connected to said elongated member positioned on the said left side of said leg board between said first end of said elongated member and said second end of said elongated member, and a second longitudinally adjustable member having a first end rotatably connected to said right side of said toe portion of said foot board and a second end rotatably connected to said elongated member positioned on the said right side of said leg board between said first end of said elongated member and said second end of said elongated member, whereby a force supplied to said second end of said rigid elongated members and away from said foot board causes said foot board to rotate where said horizonal support member is rotatably connected to said vertical support member.

2. A therapeutic apparatus for stretching the muscles of the lower leg of a patient as set forth in claim 1 to further comprise a bent knee pad positioned on said top side of said leg board, said bent knee pad having a first end, a second end, a midsection, a top and a bottom and wherein said midsection has a thickness from said bottom to said top which is greater than the thickness from said bottom to said top at said first end and at said second end whereby the leg of a patient using said apparatus is bent when fixedly secured to said leg board whereby muscles of the leg are stretched which may only be stretched when the leg is bent.

3. A therapeutic apparatus for stretching the muscles of the lower leg of a patient as set forth in claim 1 to further comprise a flat knee pad positioned on said top side of said leg board whereby the leg of a patient using said apparatus is straight when fixedly secured to said leg board whereby muscles of the leg are stretched which may only be stretched when the leg is straight.

4. A therapeutic apparatus for stretching the muscles of the lower leg of a patient as set forth in claim 1 wherein the axis of rotation where said first horizontal support member is rotatably connected to said first vertical support member and the axis of rotation where the second horizontal support member is rotatably connected to said second vertical support member are aligned and said axis is sufficiently positioned above said leg board such that said axis is in substantial alignment with the axis of rotation of the ankle of the patient.

5. A therapeutic apparatus for stretching the muscles of the lower leg of a patient as set forth in claim 1 to further comprise an angled inversion/eversion pad positioned on said top side of said foot board whereby the foot of a patient using said apparatus is caused to be exerted such that the lateral portion of the foot is more distant from the foot board than is the medial side of the foot of the patient when the leg of the patient is placed in the apparatus.

6. A therapeutic apparatus for stretching the muscles of the lower leg of a patient as set forth in claim 1 to further comprise an angled inversion/eversion pad positioned on said top side of said foot board whereby the foot of a patient using said apparatus is caused to be inverted such that the medial portion of the foot is more distant from the foot board than is the lateral side of the foot of the patient when the leg of the patient is placed in the apparatus.

* * * * *